US006258759B1

(12) United States Patent
Futahashi et al.

(10) Patent No.: US 6,258,759 B1
(45) Date of Patent: Jul. 10, 2001

(54) METAL WORKING WATER AND METAL WORKING COMPOSITION

(76) Inventors: Sadao Futahashi, 3-3, Kanaya 1-Chome, Yokaichi, Yokaichi-shi, Shiga (JP), 527-0028; Yasuo Fukutani, 252-7, Iba, Notogawa-Cho, Kanzaki-gun, Shiga (JP), 521-1235; Yukio Wada, 2374, Takamiya-Cho, Hikone-shi, Shiga (JP), 522-0292; Eiichiro Nakayama, B-102, 1700, Kaideima-Cho, Hikone-shi, Shiga (JP), 522-0056

( * ) Notice: Subject to any disclaimer, the term of this patent is extended or adjusted under 35 U.S.C. 154(b) by 0 days.

(21) Appl. No.: 09/529,838

(22) PCT Filed: Jan. 14, 1998

(86) PCT No.: PCT/JP98/00105

§ 371 Date: Apr. 19, 2000

§ 102(e) Date: Apr. 19, 2000

(87) PCT Pub. No.: WO99/21944

PCT Pub. Date: May 6, 1999

(30) Foreign Application Priority Data

Oct. 24, 1997 (JP) ..... 9-292798

(51) Int. Cl.[7] ..... C10M 173/02

(52) U.S. Cl. ..... 508/143; 508/161; 508/173; 508/180

(58) Field of Search ..... 508/143, 161, 508/173, 180

(56) References Cited

U.S. PATENT DOCUMENTS 2,990,369 * 6/1961 Shapiro .
4,406,812 * 9/1983 Childers .
4,828,730 * 5/1989 Molmans .
5,534,172 * 7/1996 Perry et al. .
5,624,888 * 4/1997 Przybylski et al. .
5,716,917 * 2/1998 Williams et al. .
5,859,124 * 1/1999 Yorifuji et al. .

FOREIGN PATENT DOCUMENTS

99/66014 * 12/1999 (WO) .

* cited by examiner

*Primary Examiner*—Jerry D. Johnson
(74) *Attorney, Agent, or Firm*—Milde, Hoffberg & Macklin, LLP

(57) ABSTRACT

A metal-working water or a metal-working composition which has excellent cooling and lubricating properties and does not exert a harmful influence on the environment. A metal-working water containing sodium ion and one or more kinds selected from the group consisting of fluoride ion, hydrogencarbonate ion and silicon and being adjusted to pH 6.0 to pH 10 can be used as a substitute for a conventional cutting oil. A metal-working composition including a metal-working water with such additive as a rust-preventive agent and being adjusted to pH 6.0 to pH 10 can also be used.

8 Claims, No Drawings

METAL WORKING WATER AND METAL WORKING COMPOSITION

FIELD OF THE INVENTION

The present invention relates to a metal-working water and a metal-working composition containing the same. More particularly, the invention relates to a metal-working water and a metal-working composition containing the same, which can be used as a substitute for a cutting oil.

BACKGROUND OF THE INVENTION

Cutting metals such as an iron, aluminum, and various types of alloys is one of the metal-working processes for removing unnecessary parts from a metal workpiece with the use of a cutting tool to provide a desired shape, size or surface to the metal workpiece. In any cases of metal working, big friction occurs between a workpiece and a tool. Frictional heat burns the tool and makes the machined surface of the workpiece rough, and thermal expansion lowers the accuracy of the shape and the size of the workpiece and the tool, thus causing various problems. To reduce the above problems, a cutting fluid or a lubricant has been employed in metal cutting.

Water-soluble and water-insoluble cutting oils are commonly used as a cutting fluid or a lubricant.

A typical example of water-insoluble cutting oils is an oil solution including mineral oil, sulfur, and chlorine. The disadvantage of the oil solution is that it can be used only when the cutting temperature is low because high cutting temperature may cause the production of fire and smoke. In the meanwhile, a water-soluble cutting oil including mineral oil and the like, to which soap and sulfate are added as an emulsifier or higher alcohol and fatty acid ester are added as a binder, can be used. It is generally used after being diluted with water. A water-soluble cutting oil has an excellent lubricity, but on the other hand, it has low cooling property.

Both water-insoluble and water-soluble cutting oils can be used repeatedly in cutting operation. However, the bacteria propagates in cutting oils as time goes by, and the cutting oil gives off a bad smell by the bacteria itself or the gas produced by the bacteria. The disposal of used cutting oil has become the serious problem because the mineral oil and emulsifier contained in the cutting oil inflicts a bad influence on the environment when the oil is discharged as a waste liquid.

One of the objectives of the present invention is to provide a metal-working water or a metal-working composition containing the same, which is mainly used to cut metals, has an excellent lubricity and cooling property, prevents abrasion of a cutting tool and can extend service life of a tool.

Another objective of the present invention is to provide a metal-working water or a metal-working composition containing the same, which can be used a number of times and does not include hazardous substances.

DISCLOSURE OF THE INVENTION

As the result of our researches to remove the above disadvantages, we have eventually completed the present invention.

A metal-working water of the present invention may contain sodium ion and one or more kinds selected from the group consisting of fluoride ion, hydrogencarbonate ion ($HCO_3^-$) and silicon, which is adjusted to a pH of 6.0 to 10. Preferably, a metal-working water of the present invention may contain 0.005 to 10 wt % of sodium ion and one or more kinds selected from the group consisting of 0.0005 to 10 wt % of fluoride ion, 0.01 to 10 wt % of hydrogencarbonate ion and 0.0001 to 1 wt % of silicon. A metal-working composition of the present invention may contain the above metal-working water and one or more additives. A metal-working composition of the present invention may contain the above metal-working water and a rust-preventive agent. In another embodiment, a metal-working composition of the present invention may contain the above metal-working water, glycerol, a surface active agent and a rust-preventive agent.

The term, "metal working", is used herein in a comprehensive sense, i.e., to broadly refer to metal cutting such as cutting with an edge tool, turning, drilling, planing and milling, and grinding with abrasive grain such as honing and lapping. It is not limited to metal cutting, but includes rock drilling or the like.

DESCRIPTION OF THE PREFERRED EMBODIMENTS

A metal-working water of the present invention can be obtained by dissolving sodium ion and one or more kinds selected from the group consisting of fluoride ion, hydrogencarbonate ion and silicon in such water as tap water, well water, demineralized water or distilled water, which has a melting point of 0° C., a boiling point of 100° C. and a density of about 1.00 g/cm$^3$ at the temperature of 4° C., and then being adjusted to a pH of 6.0 to 10.

Alternatively, a metal-working water of the present invention can be obtained by dissolving sodium ion and one or more kinds selected from the group consisting of fluoride ion, hydrogencarbonate ion and silicon in alkaline components of a tap water extracted by electrolyzing the tap water. The method for dissolving sodium ion and one or more kinds selected from the group consisting of fluoride ion, hydrogencarbonate ion and silicon with water is not particularly limited. Any conventional method well-known by the persons skilled in the art can be used in the present invention. One of the direct and easy methods is the method containing a step of dissolving a suitable amount of compounds containing sodium, fluorine, hydrogencarbonate or silicon in water. Such compounds are not particularly limited. Any compounds containing one or more kinds selected from the group consisting of sodium, fluorine, hydrogencarbonate and silicon, which are known by the persons in the art, can be used. For example, potassium fluoride, potassium fluoride dehydrate, potassium hydrogenfluoride, ammonium fluoride, ammonium hydrogenfluoride, sodium fluoride, sodium hydrogenfluoride, sodium chloride, sodium hydroxide, sodium hydrogencarbonate, sodium carbonate, sodium carbonate monohydrate, potassium hydrogencarbonate, ammonium hydrogencarbonate and the like can be used. The method for blowing gaseous carbon dioxide directly to water can be also used as one of the methods for dissolving hydrogencarbonate ion in water. Water glass, sodium metasilicate, sodium orthosilicate, and sodium metasilicate hydrate can be used as a compound containing silicon. However, the compound which can be used in the present invention is not limited by the above. A metal-working water can be also obtained by preparing a solution containing a high concentration of sodium ion and one or more kinds selected from the group consisting of fluoride ion, hydrogencarbonate ion and silicon, and then appropriately diluting the solution with water to arbitrarily adjust an ion concentration of said solution. The pH of the water used to dilute the solution is not particularly limited.

The concentrations of sodium ion, fluoride ion, hydrogencarbonate ion, and silicon are not particularly limited.

However, in the case that the concentrations of these substances are considerably low in a metal-working water, the water does not work effectively in metal-working. Higher concentrations of these substances may lead to higher cutting efficiency. However, when these concentrations are reached at a certain level, cutting efficiency is no longer increased. Therefore, unnecessarily high concentrations of these substances are not preferable because they uselessly raise the cost and make it difficult to prepare a metal-working water. To be concrete, the fluoride ion content of a metal-working water is 0.0005 to 10 wt %, the hydrogencarbonate ion content is 0.01 to 10 wt % and/or the silicon content is 0.0001 to 1 wt %, and the sodium content is 0.005 to 10 wt %. Preferably, the fluoride ion content of a melt working water is 0.0005 to 1 wt %, the hydrogencarbonate ion content is 0.01 to 1 wt % and/or the silicon content is 0.0001 to 0.5 wt %, and the sodium content is 0.005 to 1 wt %. The optimum concentration of each ion in a metal-working water may vary with a kind of the metal of a workpiece.

A metal-working water of the present invention can be used as a substitute for a conventional cutting oil. However, a cutting tool and a workpiece can be easily rusted when a metal-working water is left on them. Therefore, it is preferable to add an additive such as a rust-preventive agent to a metal-working water of the present invention to prepare a composition, which can be used as a substitute for a conventional cutting oil. Any rust-preventive agents commercially available can be used in the present invention. For example, such rust-preventive agents as ion coat type agent, paraffin wax, and carnauba wax can be used. More specifically, the RUSTCOAT series solvent cutback type rust-preventive agent produced by Showa Shell Sekiyu K. K., Radiator Protector produced by SOFT 99 CORPORATION, carnauba wax produced by Ishihara Chemical Co., Ltd. and the like can be taken as an example.

As the need arises, various fats, oils, a surface active agent and glycerol can be added to prepare a metal-working composition of the present invention. The kinds and the amount of these additives may vary with the kind of a metal workpiece.

The followings can be used as fats and oils in the present invention; such vegetable oils as cotton seed oil, corn oil, sesame oil, olive oil, camellia oil, palm oil, soybean oil, rapeseed oil, sunflower seed oil, coconut oil, linseed oil and paulownia oil; such animal oils as lard, mutton tallow, whale oil, fish oil and liver oil; such mineral oil as vaseline; or a mixed oil selected from the above oil, and salad oil on the market. However, fats and oils used in the present invention are not limited by the above and any well-known fats and oils or processed fats and oils can be used as an additive.

The surface active agent used in the present invention may include cationic surface active agent, anionic surface active agent and amphoteric surface active agent, and natural substances such as gelatin. To be concrete, Triton X-100 is taken as an example of a surface active agent.

The rust-preventive agent content of metal-working water is not particularly limited, however, preferably 0.1 to 2 wt % and, more preferably, 0.5 to 2 wt %.

The glycerol content or the fat or oil content are not particularly limited, however, preferably 1 to 5 wt %. The surface active agent content is not particularly limited, however, preferably 0.001 to 0.2 wt % of a surface active agent such as Triton is contained in a metal-working water.

A metal-working water or a metal-working composition of the present invention can be used as a substitute of a conventional cutting oil or fluid.

As a cutting tool, single-point tools such as a bite, multiple-point tools such as a drill, a reamer, a milling cutter, a broach, a saw and a shank, and formed tool which cutting edge has the same shape as a specific outline of a product can be used in the present invention.

As a material of a cutting tool, carbon tool steel, high-speed steel, cast nonferrous alloys, cemented carbides, cemented oxides, diamonds, artificial abrasive grain and the like can be used.

As a workpiece, bar steels such as a round bar, a square bar and a hexagonal bar steel, and steel plates can be used in the present invention. More specifically, the followings can be used as a workpiece; a structural rolled steel, a carbon steel, a molybdenum steel plate, a round bar for rivet, a chain bar, a rolled steel for the purpose of welding, a hot rolled mild steel plate and a steel plate in coil, a cold rolled steel and a steel plate in coil, a carbon steel tube for general structural purpose, a carbon steel tube for machine structural use, a carbon steel pipe for ordinary piping, a carbon steel pipe for pressure piping, a carbon steel pipe for high pressure piping, a carbon steel pipe for high temperature piping, alloy steel pipe for ordinary piping, low carbon steel wire rods, high carbon steel wire rods, carbon steels for machine structural use, nickel, chrome steel, aluminum, chrome, molybdenum steel, stainless steel, and the like. However, workpieces used in the present invention are not limited by the above.

A metal-working water and a metal-working composition of the present invention can prevent such damages as damage by heat of a cutting tool, destruction of a cutting blade and increasing abrasion of a cutting blade.

A metal-working water and a metal-working composition of the present invention, for example, are supplied to a pomp of a circular sawing machine, a bench drilling machine, a turning machine, a rock drill and the like and are used as a substitute for a conventional cutting fluid or a lubricant to cut and drill a round bar, and to produce a flange surface.

A metal-working water or a metal-working composition of the present invention is characterized by a lower viscosity than conventional cutting oils, smooth liquid current, excellent circulation in a pomp and no loading. Moreover, a metal-working water or a metal-working composition of the present invention has an excellent lubricity and excellent cooling property to prevent frictional heat produced between a tool and a workpiece, so that the effective tool life can be increased. In addition, by using a metal-working water and a metal-working composition of the present invention, no trace of a bite is left on the flange surface of a workpiece, so that the workpiece is finished nicely in appearance.

A metal-working water and a metal-working composition containing the same of the present invention will be more clearly understood by referring to the Examples below. However, the Examples should not be construed to limit the invention in any way. It will be apparent to one of ordinary skill in the art that various changes and modifications can be made thereto without departing from the spirit or scope of the present invention.

EXAMPLE 1

A metal-working water of the present invention was prepared by adding 0.5 g of sodium hydrogencarbonate to 1 liter of distilled water with a pH of 7.3.

EXAMPLE 2

A metal-working water of the present invention was prepared by adding 0.5 g of sodium fluoride to 1 liter of distilled water with a pH of 7.3.

EXAMPLE 3

A metal-working water of the present invention was prepared by adding 0.5 g of sodium silicate to 1 liter of distilled water with a pH of 7.3.

EXAMPLE 4

A metal-working water of the present invention was prepared by adding 2.5 g of sodium silicate to 1 liter of distilled water with a pH of 7.3.

EXAMPLE 5

1 kg of mixture was obtained by adding 54.5 g of sodium hydrogencarbonate, 19 g of sodium fluoride and 4.5 g of sodium silicate to distilled water with a pH of 7.0. Then the mixture was diluted 250 times with water to prepare a metal-working water.

EXAMPLE 6

1 kg of mixture was obtained by adding 54.5 g of sodium hydrogencarbonate, 19 g of sodium fluoride and 4.5 g of sodium silicate to distilled water with a pH of 7.0. Then the mixture was diluted 25 times with water to prepare a metal-working water.

EXAMPLE 7

1 wt % of RUSTCOAT 201 (produced by Showa Shell Sekiyu K. K.) was added to each metal-working water prepared in Examples 1 to 6 to obtain a metal-working composition.

EXAMPLE 8

54.5 g of sodium hydrogencarbonate, 19 g of sodium fluoride, 26.6 g of sodium chlorine, 4.5 g of sodium silicate, 625 CC of glycerol, 625 CC of vaseline, 125 CC of TritonX-100, and 3750 CC of RUSTCOAT 201 were added to 1 liter of distilled water with a pH of 7.0. This mixture was diluted 250 times with water to obtain a metal-working water of the present invention.

EXAMPLE 9

Each metal-working water obtained in Examples 1 to 6 was supplied respectively to a pomp of the circular sawing machine "CK-311GL" (a product of Tsune Precision Machine Co., Ltd.). By using each metal-working water, the 70-edged cutter with a diameter of 380 to 400 mm was operated at 20 r.p.m. and 70 mm per minute of feeding speed. In each case, the metal-working water flowed smoothly. The effective life of the cutter was examined by cutting 65 mm-thick stainless round bars "45G". In the case of using conventional cutting oil, the cutter reached the limit of its effective life and had to be changed when the 1,300 workpieces was cut at the rate of one workpiece per minute. In the cases of using each metal-working water obtained in Examples 1 to 6, the 1,450 workpieces could be cut smoothly with the cutter. However, the workpieces, which were cut by using a metal-working water obtained by Examples 1 to 6 were rusted afterwards.

EXAMPLE 10

Each metal-working water obtained in Examples 1 to 6 was supplied respectively to a pomp of the bench drilling machine. By using this machine, a 50 mm-depth hole was drilled in a workpiece at 540 r.p.m. and at the feeding speed of 0.25 mm per rotation. As the result, unlike conventional cutting fluids, metal chips of original workpiece color were generated and no burnout could not be found on the metal surface, when a hole was drilled.

EXAMPLE 11

In the same way as Example 9, each metal-working water obtained in Examples 1 to 6 was supplied respectively to a pomp of the circular sawing machine "CK-311GL" ( a product of Tsune Precision Machine Co., Ltd.). By the use of each metal-working of water, the 70-edged cutter with a diameter of 380 to 400 mm was operated at 20 r.p.m. and 70 mm per minute of a feeding speed in each case. In each case, the metal-working water flowed smoothly. The metal removal rate was examined by cutting a 10-mm-thick aluminum alloy plate and stainless plate with the cutter. In the case of using conventional cutting oil, Tapping Compound, smoke generated when a stainless steel was cut, thus cutting operation could not be continued. In the case of using metal-working water of the present invention, a stainless steel was cut smoothly without generating smoke. In the meanwhile, it was difficult to cut an aluminum alloy plate by the use of metal-working waters obtained in the Examples 1 to 3, 5 and 6. However, an aluminum alloy was cut smoothly by the use of a metal-working water obtained in Example 4 and Tapping Compound.

EXAMPLE 12

In the same way, each metal-working composition obtained in Examples 7 and 8 was supplied respectively to a pomp of the double-end milling type centering machine "GK-600FBNG" (a product of Sekigahara Seisakusyo Co., Ltd.). By the use of this machine, flange surface was produced on the 45G steel. In each case, the composition flowed smoothly, the finished flange surface was glossy and no trace of a bite was left. On the contrary, in the case of using conventional cutting oil, rough traces of bites were left on the flange surface and the pomp was clogged.

The results of the cutting tests of Examples 9 to 11 by the use of the metal-working waters obtained in Examples 1 to 6 are shown in Table 1.

TABLE 1

| | Composition | Cutting of Steel | Drilling | Aluminum Plate | Stainless Plate |
|---|---|---|---|---|---|
| EXAMPLE 1 | $NaHCO_3$ | ○ | ○ | × | ○ |
| EXAMPLE 2 | NaF | ○ | ○ | × | ○ |
| EXAMPLE 3 | $Na_4SiO_4$ (0.5 g/l) | ◎ | ◎ | × | ○ |
| EXAMPLE 4 | $Na_4SiO_4$ (1.5 g/l) | ◎ | ◎ | ○ | ○ |
| EXAMPLE 5 | $NaHCO_3$, NaF, $Na_4SiO_4$ | ◎ | ◎ | × | ○ |
| EXAMPLE 6 | $NaHCO_3$, NaF, $Na_4SiO_4$ (×10) | ◎ | ◎ | × | ○ |
| COMPARISON | Tapping Compound | ○ | ○ | ○ | × |

Industrial Applicability

A metal-working water or a metal-working composition, which is used as a substitute for a conventionally-used cutting oil, can be obtained according to the invention. The metal-working water or the metal-working composition has a low viscosity, excellent liquid flow in a pomp, excellent lubricating and cooling properties. Therefore, a metal-working water or a metal-working composition of the present invention increases the useful life of a cutting tool and improves the operation efficiency. Moreover, waste fluid of a metal-working water or a metal-working composition does not include environmentally hazardous substances.

There has thus been shown and described a novel metal working water and metal working composition which fulfills all the objects and advantages sought therefor. Many changes, modifications, variations and other uses and applications of the subject invention will, however, become apparent to those skilled in the art after considering this specification and the accompanying drawings which disclose the preferred embodiments thereof. All such changes, modifications, variations and other uses and applications which do not depart from the spirit and scope of the invention are deemed to be covered by the invention, which is to be limited only by the claims which follow.

What is claimed is:

1. A cutting fluid comprising water, silicon and ions of fluoride, hydrogencarbonate and sodium, and having a pH of 6.0 to 10 at room temperature.

2. A cutting fluid according to claim 1, wherein said cutting fluid contains 0.0005 wt % to 10 wt % of fluoride ion, 0.01 wt % to 10 wt % of hydrogencarbonate ion, 0.0001 wt % to 1 wt % of silicon, and 0.005 wt % to 10 wt % of sodium ion.

3. A method for cutting metals comprising the step of contacting said metal with the cutting fluid of claim 2.

4. A cutting fluid according to claim 1, wherein said cutting fluid additionally contains an additive selected from the group consisting of rust-preventive agent, fats, oils, a surface active agent and glycerol.

5. A cutting fluid according to claim 4, wherein said additive comprises a rust-preventive agent.

6. A method for cutting metals comprising the step of contacting said metal with the cutting fluid of claim 5.

7. A method for cutting metals comprising the step of contacting said metal with the cutting fluid of claim 4.

8. A method for cutting metals comprising the step of contacting said metal with the cutting fluid of claim 1.

* * * * *